US009828789B2

(12) United States Patent
Bulancea

(10) Patent No.: US 9,828,789 B2
(45) Date of Patent: Nov. 28, 2017

(54) LOCKING AND SEALING ARRANGEMENT FOR A LOAD SWITCH HANDLE

(71) Applicant: Leviton Manufacturing Co., Inc., Melville, NY (US)

(72) Inventor: Marian Bulancea, Middle Village, NY (US)

(73) Assignee: Leviton Manufacturing Co., Inc., Melville, NY (US)

( * ) Notice: Subject to any disclaimer, the term of this patent is extended or adjusted under 35 U.S.C. 154(b) by 152 days.

(21) Appl. No.: 14/978,020

(22) Filed: Dec. 22, 2015

(65) Prior Publication Data

US 2017/0175424 A1 Jun. 22, 2017

(51) Int. Cl.

| | |
|---|---|
| ***E05B 17/00*** | (2006.01) |
| ***E05B 67/38*** | (2006.01) |
| ***E05B 1/00*** | (2006.01) |
| ***E05B 15/00*** | (2006.01) |
| ***E05B 65/08*** | (2006.01) |
| ***E05B 3/06*** | (2006.01) |
| ***E05B 65/00*** | (2006.01) |

(52) U.S. Cl.

CPC ..... *E05B 17/002* (2013.01); *E05B 1/003* (2013.01); *E05B 1/0015* (2013.01); *E05B 3/06* (2013.01); *E05B 15/00* (2013.01); *E05B 15/0033* (2013.01); *E05B 65/001* (2013.01); *E05B 65/0894* (2013.01); *E05B 67/38* (2013.01)

(58) Field of Classification Search

CPC ..... E05B 1/00; E05B 1/0007; E05B 1/003; E05B 3/00; E05B 3/06; E05B 3/065; E05B 15/00; E05B 15/0033; E05B 17/00; E05B 17/002; E05B 65/001

USPC ..... 277/530

See application file for complete search history.

(56) References Cited

U.S. PATENT DOCUMENTS 2,818,287 A * 12/1957 Josephson ..... F04B 53/143 166/120
3,047,300 A * 7/1962 Taylor ..... F16J 15/3204 277/530

(Continued)

FOREIGN PATENT DOCUMENTS

WO 9801882 A1 1/1998
WO 0108180 A1 2/2001

(Continued)

OTHER PUBLICATIONS

Leviton Manufacturing Co., Inc., Product Bulletin, "powerswitch, 30-Amp. Non-Fused Safety Disconnect Switch"; 2015.

*Primary Examiner* — Christopher Boswell

(57) ABSTRACT

A handle assembly includes a handle, a handle seal recess, and a hub engaging portion. A hub has a lock receiving surface and a handle engaging portion. A shaft is receivable within the hub and has first and second ends, the first end engaged with the handle, and the second end rotatable by rotating the grasping portion of the handle. A V-ring is disposed within the handle seal recess and engages the hub to prevent moisture ingress between the handle and the hub. The hub has a seal recess and an X-ring and an O-ring disposed therein to seal against the shaft to prevent moisture ingress between the hub and the shaft. Axial pressure applied to the O-ring by the hub engaging portion of the handle causes the O-ring to press against the X-ring to force at least one lobe of the X-ring against the central portion of the shaft.

23 Claims, 13 Drawing Sheets

(56) References Cited

U.S. PATENT DOCUMENTS

| | | | | |
|---|---|---|---|---|
| 3,527,507 | A * | 9/1970 | Clark | F16C 29/02 277/346 |
| 4,184,690 | A * | 1/1980 | Brown | F16J 15/26 277/515 |
| 5,219,070 | A | 6/1993 | Grunert et al. | |
| 5,243,157 | A | 9/1993 | Hoffman | |
| 5,408,853 | A * | 4/1995 | Yamada | E05B 13/002 70/210 |
| 5,571,023 | A | 11/1996 | Anthony | |
| 5,609,244 | A | 3/1997 | Reiter | |
| 5,862,690 | A | 1/1999 | Jancsek | |
| 5,902,973 | A | 5/1999 | Ramey et al. | |
| 6,192,718 | B1 | 2/2001 | Bollinger, Jr. et al. | |
| 6,194,983 | B1 | 2/2001 | Bogdon et al. | |
| 6,460,902 | B1 * | 10/2002 | Kyle | E05C 1/145 114/203 |
| 6,913,297 | B2 * | 7/2005 | Jackson | E05B 1/0092 292/195 |
| 7,186,933 | B2 | 3/2007 | Turner | |
| 7,227,079 | B2 | 6/2007 | Noest et al. | |
| 7,258,556 | B1 | 8/2007 | Boutros et al. | |
| 7,399,934 | B2 | 7/2008 | Emura et al. | |
| 7,819,443 | B2 * | 10/2010 | Ryan | E05B 3/00 292/336.3 |
| 9,080,347 | B2 * | 7/2015 | Le | E05B 1/003 |
| 9,556,646 | B2 * | 1/2017 | Matre | E05B 15/0033 |
| 2005/0005403 | A1 * | 1/2005 | Jien | E05B 17/002 16/415 |
| 2008/0179072 | A1 | 7/2008 | Drane et al. | |
| 2012/0000256 | A1 * | 1/2012 | Stuckey | E05B 35/008 70/91 |
| 2014/0118103 | A1 | 5/2014 | Boyer | |
| 2014/0353130 | A1 | 12/2014 | Sekikawa | |
| 2015/0221459 | A1 | 8/2015 | Oneufer et al. | |
| 2015/0275543 | A1 * | 10/2015 | Karnutsch | E05B 1/003 248/551 |
| 2016/0072266 | A1 | 3/2016 | Bulancea | |

FOREIGN PATENT DOCUMENTS

| | | | |
|---|---|---|---|
| WO | 0116988 | A1 | 3/2001 |
| WO | 2010071922 | A1 | 7/2010 |
| WO | 2010130099 | A1 | 11/2010 |
| WO | 2013155545 | A1 | 10/2013 |
| WO | 2015119775 | A1 | 8/2015 |

* cited by examiner

LOCKING AND SEALING ARRANGEMENT FOR A LOAD SWITCH HANDLE

FIELD OF THE DISCLOSURE

The present disclosure relates generally to electrical disconnect handles, and more particularly to an electrical disconnect handle assembly having enhanced security, sealing, and cleaning features.

BACKGROUND OF THE DISCLOSURE

Electrical disconnects are used in a variety of commercial applications, both indoors and outdoors, for energizing and de-energizing electrical devices, such as lights, fans, pumps, generators and the like. Typically, an electrical disconnect includes an external handle connected to a switch element located within an electrical enclosure, or box. The handle may or may not include lockout features to prevent unauthorized operation of the associated electrical device.

As will be appreciated, electrical disconnects and associated electrical enclosures find wide industrial application, and thus they may be employed in a variety of environments. Some environments may be subject to rain (for outdoor applications), water spray (for indoor applications in which a hygienic work space is required) and/or dust. In addition, due to the increasing intensity of weather events, it may become important for electrical devices to withstand temporary or permanent submersion.

The National Electrical Manufacturers Association (NEMA) and Underwriters Laboratories (UL) provides standards for protection provided by certain enclosure "types." For example, NEMA Type 6/6P enclosures must provide protection from ingress of solid foreign objects, as well as the ingress of hose directed water and water during temporary or prolonged submersion at a limited depth. Similarly, the International Electrotechnical Commission (IEC) also provides standards for protection of enclosures. For example, an enclosure meeting the IEC's International Protection (IP) Code IP67, IP68 or IP69 must provide protection from dust, as well as protection from powerful jets of water and/or total immersion of the enclosure. In addition, NEMA/UL50E type 6, 6p and IEC equivalent IP67, IP68 provide standards for enclosures subjected to temporary submersion (on the order of minutes) and permanent submersion (on the order of hours or days).

Further, the Occupational Safety & Health Administration (OSHA) provides standards for lockout of electrical disconnects using one or more external locks. Such lockout controls can be important when machinery is being serviced to ensure the safety of workers in the area. Under 29 C.F.R. §§1910.269, OSHA provides standards for such "Hazardous energy control (lockout/tagout)" procedures. Finally, in applications such as health care and food service industries, a variety of independent hygiene/sanitary standards (e.g., National Sanitation Foundation (NSF) standards; American National Standards Institute (ANSI), the US Department of Agriculture (USDA), Food Safety and Inspection Service (FSIS), International Association of Milk, Food and Environmental Sanitarians (IAMFES), American Meat Institute (AMI)), as well as harmonized industry standards must be adhered to so that the handles and other external surfaces of electrical disconnects can be thoroughly cleaned on a periodic basis. Similar European standards also exist.

As can be appreciated, problems exist with the existing handle and seal designs for electrical disconnects which may not be capable of simultaneously meeting all of the aforementioned sealing, lockout, and cleanability requirements. Accordingly, it would be desirable to provide an improved load switch handle and seal assembly that includes enhanced locking and sealing features that provide a desired high degree of moisture and water resistance and which is easily cleanable to meet applicable hygiene/sanitary standards.

SUMMARY OF THE DISCLOSURE

A handle assembly may include a handle having a grasping portion, a handle seal recess, and a hub engaging portion. A hub can have a lock receiving surface and a handle engaging portion. A shaft may be receivable within the hub, the shaft having first and second ends, the first end engaged with the handle, and the second end comprising an actuating surface that is rotatable by rotating the grasping portion of the handle. A first seal may be disposed within the handle seal recess. The first seal may engage a sealing face of the hub to prevent moisture ingress between the handle and the hub.

A handle assembly can include a handle having a grasping portion, a handle seal recess, and a hub engaging portion. A huh may have a lock receiving surface, a handle engaging portion and first and second hub seal recesses. A shaft may be receivable within the hub. The shaft may include first and second ends, the first end engaged with the handle, the second end comprising an actuating surface that is rotatable by rotating the grasping portion of the handle. A first seal comprising a V-ring may be disposed within the handle seal recess and the first hub seal recess. The V-ring may engage the first hub seal recess to prevent moisture ingress between the handle and the hub. A second seal may be disposed in the second hub seal recess. The second hub seal recess may be disposed about a central portion of the shaft. The second seal may comprise an X-ring. Opposing sealing surfaces of the X-ring seal engage the second hub seal recess and the central portion of the shaft to prevent moisture ingress between the hub and the shaft.

A handle assembly is disclosed, comprising a handle having a grasping portion, a handle seal recess, and a hub engaging portion. A hub may have a lock receiving surface, a handle engaging portion and first and second hub seal recesses. A shaft may be receivable within the hub. The shaft may have first and second ends, the first end engaged with the handle, the second end comprising an actuating surface that is rotatable by rotating the grasping portion of the handle. A first seal may be a V-ring disposed within the handle seal recess and the first hub seal recess. The V-ring may engage a sealing face of the hub to prevent moisture ingress between the handle and the hub. The handle and hub may further comprise respective lock receiving surfaces for receiving a shank portion of a lock therebetween. The lock receiving surface of the handle may comprise a handle ledge portion disposed opposite a handle lip portion, and the lock receiving surface of the hub may comprise a hub ledge portion disposed opposite a hub lip portion.

BRIEF DESCRIPTION OF THE DRAWINGS

By way of example, a specific embodiment of the disclosed device will now be described, with reference to the accompanying drawings, in which.

DETAILED DESCRIPTION

A handle assembly is disclosed that includes redundant sealing, locking and cleanability features rendering the assembly suitable for a variety of industrial and commercial applications. As will be described, a redundant sealing system is disclosed that enables the handle assembly to comply with waterproofing standards (e.g., NEMA-UL50E type 4, IEC IP66), submersion standards (e.g., NEMA-UL50E type 6/6P, IEC IP67/68), and standards governing exposure to high pressure waterjets/steam (e.g., IEC IP69 or IP69K (ISO)), among others. In addition, the disclosed handle assembly can include elements that reduce or eliminate the formation of crevice or pockets within the assembly, thus making it appropriate for sanitary (i.e., food service, healthcare) applications. Further, the disclosed handle assembly may include locking features that facilitate the use of a multiply-locked system to provide enhanced security against unauthorized activation or deactivation of an associated load.

Figure 1:
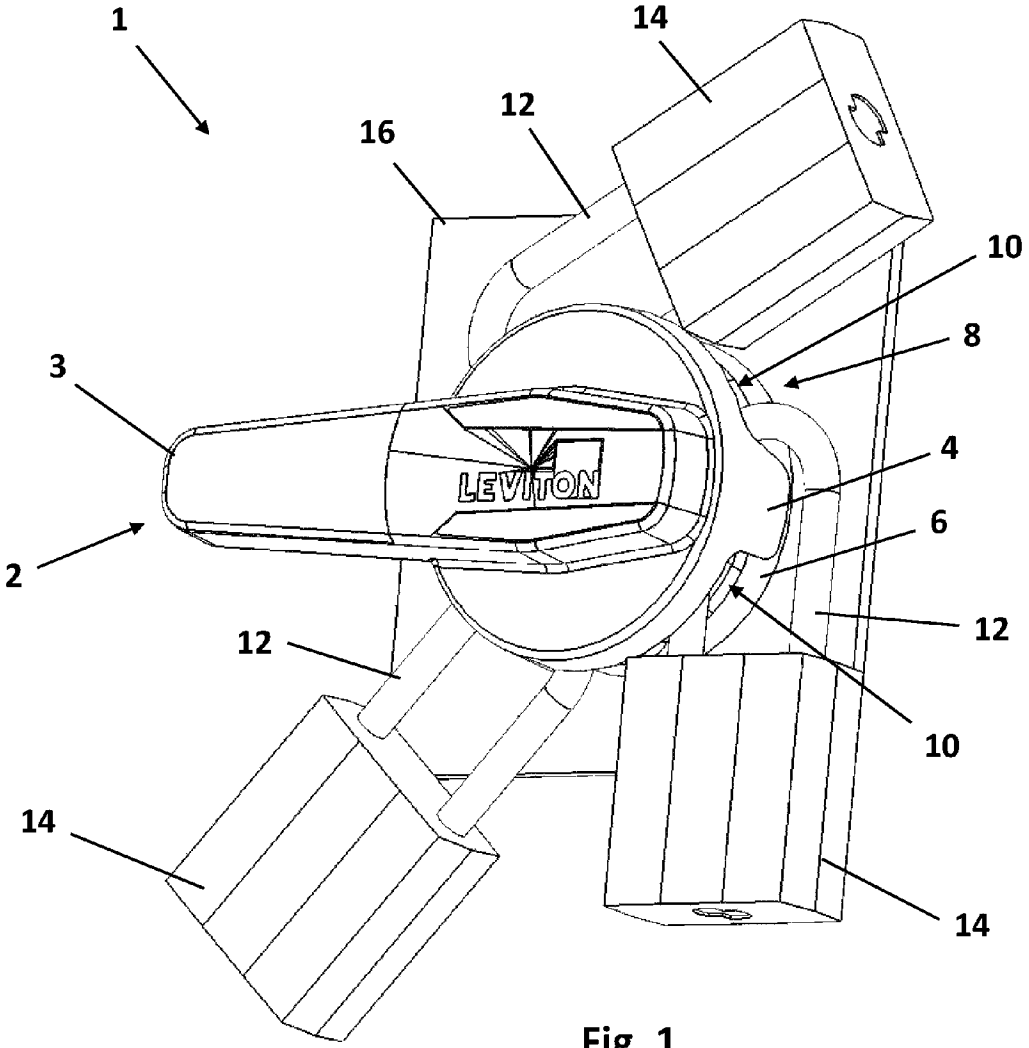
FIG. 1 is a perspective view of an embodiment of an exemplary locking and sealing arrangement according to the disclosure.

Referring now to FIG. 1, an exemplary handle assembly 1 can include a handle 2 having a laterally extending grasping portion 3 and a hub engaging portion 4. The hub engaging portion 4 may couple to a handle engaging portion 6 of a hub 8 and the two may be configured such that when assembled they form a plurality of shank openings 10 for receiving the shank portions 12 of a plurality of locks 14 therein. As will be described in greater detail later, the locks 14 may prevent operation of the handle 2 when at least one of the locks 14 is engaged with the handle assembly 1, thus providing a desired degree of security against unauthorized operation of an associated load. The handle assembly 1 may be coupled to a plate member 16 which can form part of an associated switch box or disconnect (not shown). In one non-limiting exemplary embodiment, the hub 8 may be fixed to the plate member 16 (which in some embodiments may be a door panel or a molded cover), while the handle 2 may be rotatable with respect to the hub and the plate member.

As will be appreciated, the presence of angular surfaces within the handle assembly 1, and the absence of small crevices within the assembly, enable effective cleaning of the assembly with or without the locks installed. This can be important where the handle assembly 1 is used in foodservice, healthcare or other applications in which sanitary/hygiene standards apply.

Figure 2:
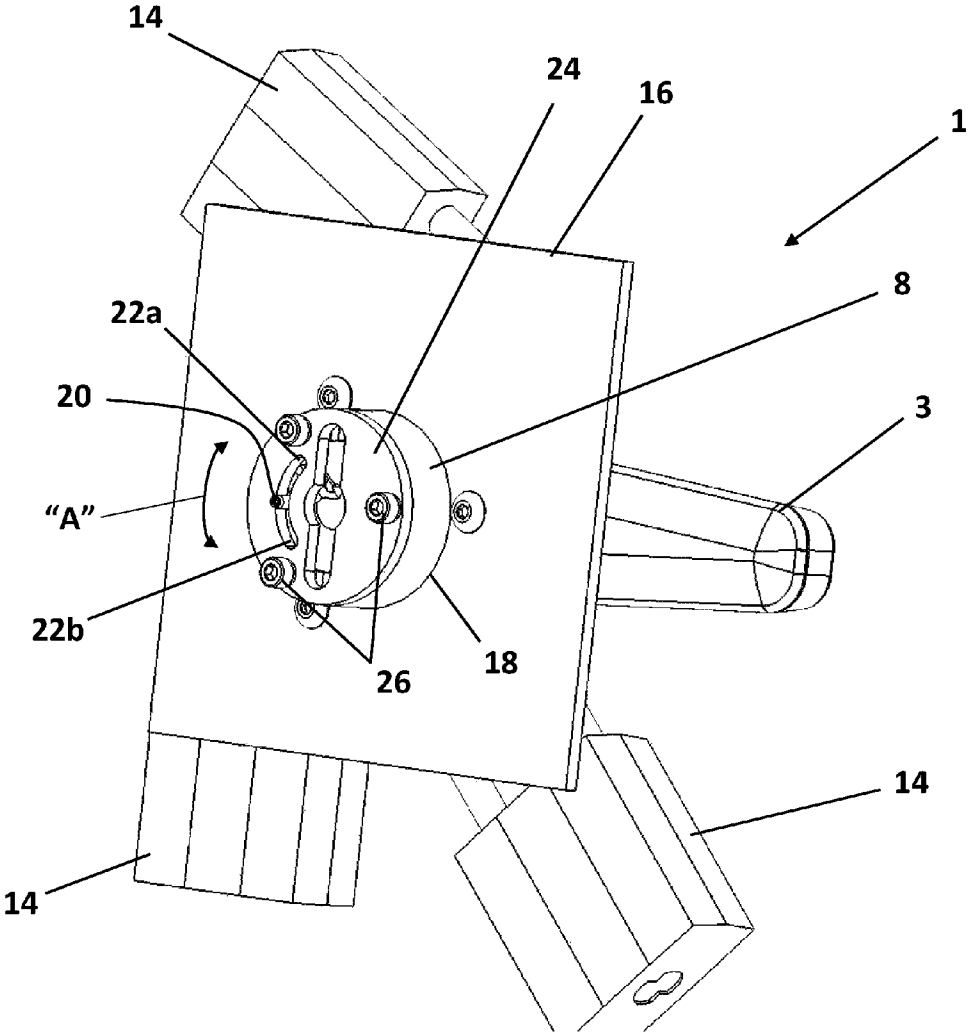
FIG. 2 is a reverse perspective view of the locking and sealing arrangement of FIG. 1.

FIG. 2 is a reverse view of the handle assembly 1 showing elements of the assembly that may reside within an associated switch box when the device is assembled. As can be seen, a portion of the hub 8 extends through an opening 18 in the plate member 16. A motion limiting pin 20 can extend through an arc-shaped opening 22 in a stop plate 24 which may be fixed to the hub 8 via a plurality of fasteners 26. The motion limiting pin 20 may be operatively coupled to the handle 2 so that when the handle is rotated along the direction of arrow "A" the actuating pin travels between first and second ends 22*a*, 22*b* of the arc-shaped opening. As will be appreciated, the range of motion of the handle 2 may be limited by the movement of the motion limiting pin 20 within the arc-shaped opening 22. In some embodiments, the motion limiting pin 20 may define the range of movement of the shaft 28, which engages a load switch element (see FIG. 9) within the switch box so that when the motion limiting pin 20 resides at the first end 22*a* of the arc-shaped opening 22 associated load is energized, and when the motion limiting pin 20 resides at the second end 22*b* of the arc-shaped opening the load is de-energized (or vice versa).

Figure 3:
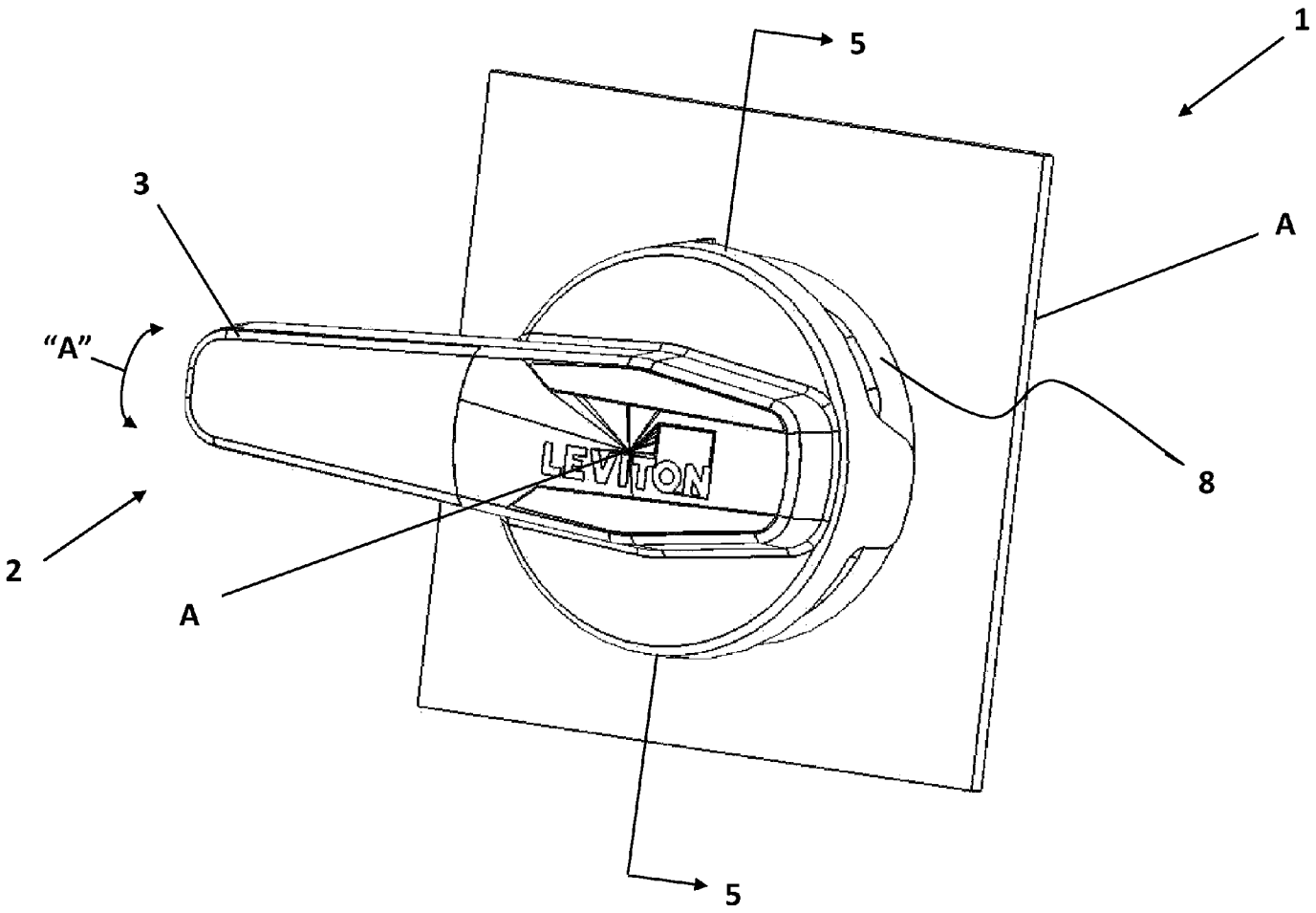
FIG. 3 is a perspective view of the locking and sealing arrangement of FIG. 1 with padlocks removed.

Referring to FIG. 3, the handle assembly 1 is shown without the plurality of locks 14 installed so that the handle 2 is free to rotate with respect to the hub 8 and the plate member 16. In the illustrated embodiment the handle is rotatable about axis "A-A," and along the direction of arrow "A," which corresponds to the previously described motion of the motion limiting pin 20.

Figure 4:
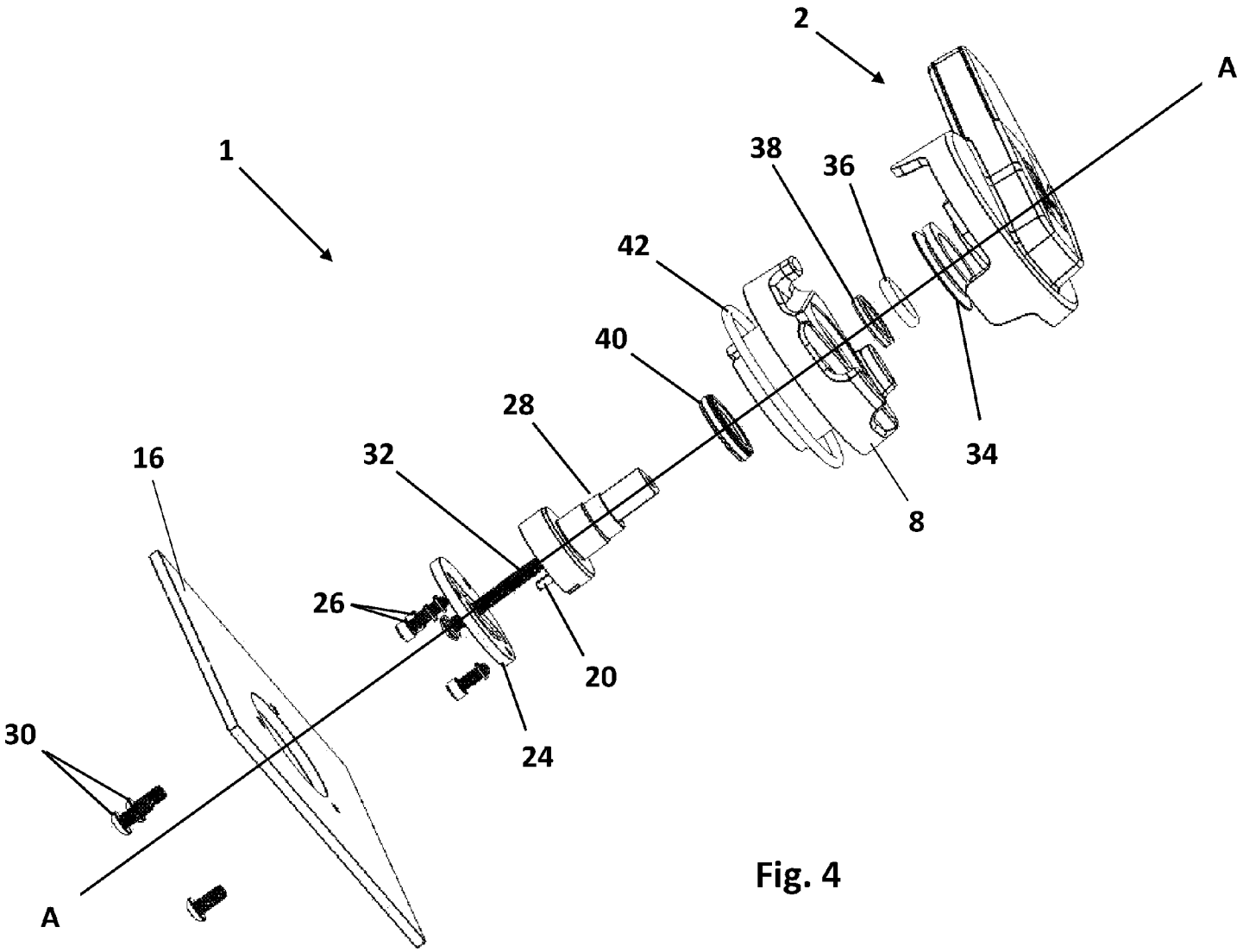
FIG. 4 is an exploded view of the locking and sealing arrangement of FIG. 3.

FIG. 4 is an exploded view of the disclosed handle assembly 1 showing the internal elements of the assembly. As mentioned, the handle assembly 1 can include a handle 2, a hub 8 and a stop plate 24 that together may be mounted to a plate member 16 of a switch box or disconnect (not shown). The handle assembly 1 may further include a shaft 28 that holds the motion limiting pin 20, a plurality of plate fasteners 30 for coupling the hub to the plate member 16, and a central handle fastener 32 for coupling the handle 2 to the shaft 28 and hub 8. In addition, a plurality of sealing elements can be provided to prevent the ingress of moisture, dust and other foreign objects into the handle assembly and into the associated switch box. In the illustrated embodiment, a first seal 34 is provided to seal between associated surfaces of the handle 2 and the hub 8. Second, third and fourth seals 36, 38, 40 are provided to seal between associated surfaces of the hub and the shaft 28. A fifth seal 42 may be provided to seal between the hub 8 and the plate member 16. In one non-limiting exemplary embodiment, the first seal 34 is a V-ring, the second seal 36 is an O-ring, the third seal 38 is an X-ring, the fourth seal 40 is a simmering, and the fifth seal 42 is an O-ring. Some or all of these seals 34-42 may be employed in the disclosed handle assembly 1 to provide a desired level of sealing against ingress of contaminants.

As will be appreciated, in some embodiments, the hub 8 and plate member 16 may be integrally formed. An example of this is where the hub and plate member are molded or otherwise formed from a polymer material, or are formed from molded or cast metal. In such cases, the fifth seal 42 may be eliminated.

It will be appreciated that the illustrated seals 34-42 may be formed of any of a variety of elastomeric materials as will be described in greater detail later. In addition, different combinations of seal materials and types may be used in place of, or in addition to, one or more of the illustrated seals. Finally, it will be understood that not all of the seals may be required for a particular application of the handle assembly 1. For example, in some applications, a desired sealing level may be achieved by using only the first seal 34. In other applications, only the first through third seals 34-38 may be used. Various combinations and arrangements of the disclosed seals are contemplated without departing from the disclosure.

Figure 5:
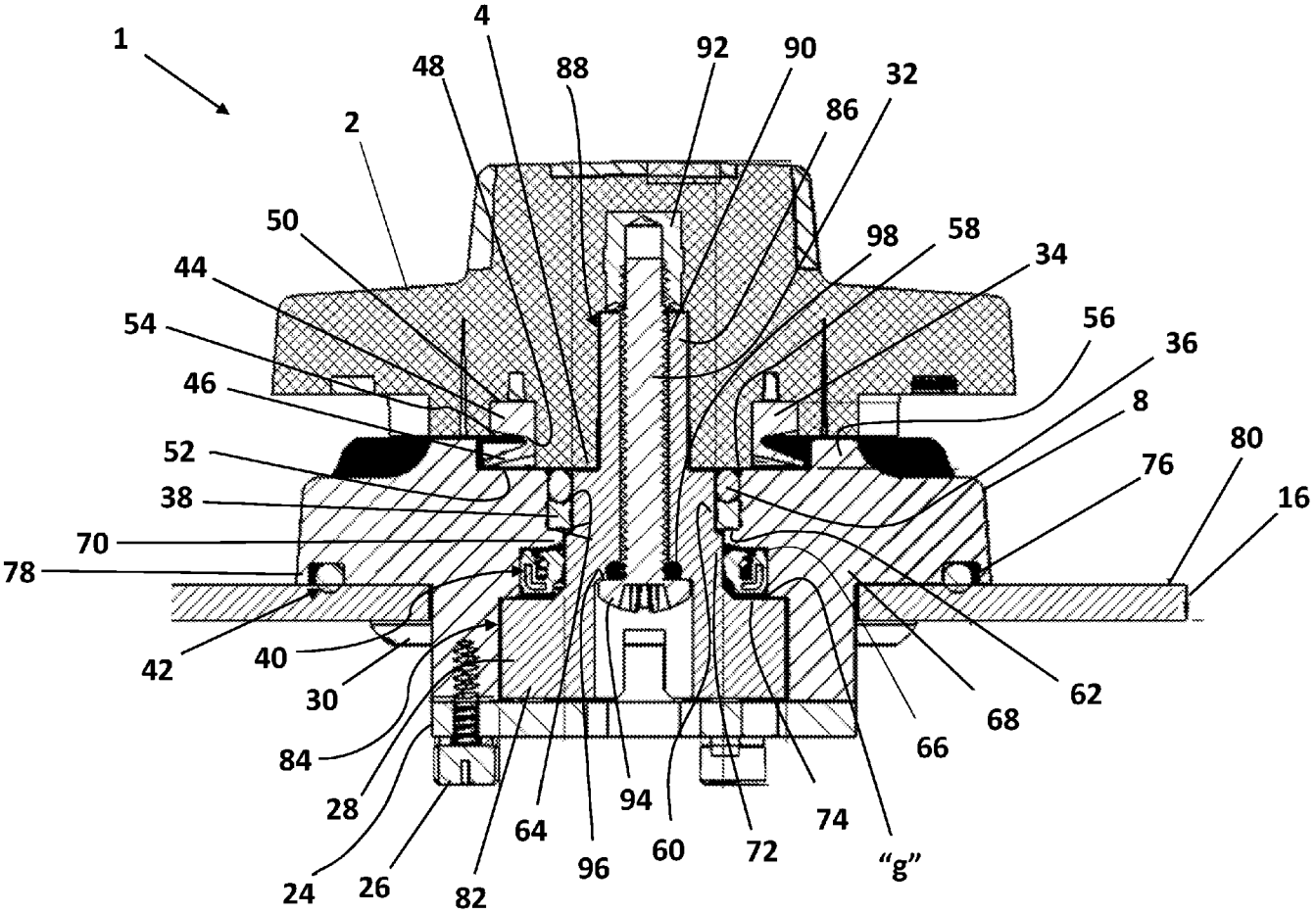
FIG. 5 is a cross-section view of the locking and sealing arrangement of FIG. 3 taken along line 5-5 of FIG. 3.

Referring now to FIG. 5, the inter-relationship between the previously described elements of the handle assembly 1 will be described in greater detail. As can be seen, the handle 2, hub 8, and shaft 28 assume a nested relationship with respect to each other, and are held in that nested configuration via central handle fastener 32. In addition, the position of the first through fifth seals 34-42 can be seen to provide sealing between the handle 2, hub 8, shaft 28 and plate element 16.

The illustrated embodiment shows an exemplary V-ring used as the first seal 34. As will be appreciated, the first seal 34 may be employed to prevent water ingress during cleaning and/or immersion of the handle assembly 1. The illustrated V-ring 34 includes a body portion 44, a lip portion 46, and a living hinge portion 48. The body portion 44 may be received within a circumferential handle seal recess 50 formed in the handle 2. In one embodiment, the V-ring is press-fit into the handle seal recess 50, though this is not critical and the V-ring could be engaged within the handle seal recess using a suitable adhesive. The lip portion 46 may protrude from the handle seal recess so that it is presented axially toward a sealing face 52 of the hub 8. In one embodiment, the sealing face 52 is part of a circumferential first hub seal recess 54 formed in a handle engaging portion 56 of the hub 8. Thus arranged, the lip portion 46 contacts the sealing face 52 of the hub 8 when the handled 2 is engaged with the hub. As the lip portion 46 engages the sealing face 52 it flexes about a living hinge portion 48, thereby increase the sealing area between the lip portion 46 and the sealing face 52 of the hub 8. As arranged, the first seal 34 prevents moisture, dust or other foreign materials from passing between the handle 2 and hub 6. The first seal 34 and the handle seal recess 50 may be sized so that the first seal 34 remains fixed to the handle 2 such that it rotates with respect to the sealing face 52 of the hub 8 when the handle is rotated. The reverse arrangement is also contemplated, and the first seal 34 could be fixed to the hub 8 and could rotate with respect to the handle 2 as the handle is rotated during operation.

The second and third seals 36, 38 may be disposed within a second seal recess 58 formed in the hub 8. The second seal recess 58 may be sized and configured to hold the second and third seals 36, 38 in a stacked relationship between the hub 8 and a central portion 60 of the shaft 28. In the illustrated embodiment, the hub engaging portion 4 of the handle 2 engages the second seal 36 when the handle is coupled to the hub 8 and applies a compressive force to the second seal. This compressive force presses the second seal 36 into the third seal 38 so that the third seal engages a bottom shoulder 62 of the second seal recess 58. In the illustrated embodiment, the second seal 36 is an O-ring while the third seal 38 is an X-ring. As such, when the O-ring 36 pressed into the X-ring 38, the O-ring extends into the concave surface of the X-ring between the lobes 64, thus causing the lobes 64 to press against the central portion 60 of the shaft 28 and against the surfaces of the hub within the second seal recess 58.

As arranged, the second and third seals 36, 38 prevent moisture, dust or other foreign materials from passing between the handle 2, hub 8, and shaft 28. The second and third seals 36, 38 thus act as a secondary seal against the ingress of material passing the first seal 34. The second and third seals 36, 38 and the second seal recess 58 may be sized so that the second and third seals remain fixed to the hub 8, and rotate with respect to the central portion 60 of the shaft 28 when the handle 2 and shaft are rotated. The reverse arrangement is also contemplated, and the second and third seals 36, 38 could be fixed to the central portion 60 of the shaft 28 and could rotate with respect to the hub 8 as the handle 2 is rotated during operation.

The fourth seal 40 may be disposed within a third hub seal recess 66 formed in a central portion 68 of the hub 8. The third hub seal recess 66 may be positioned within the hub 8 so that the second hub seal recess 58 is disposed between the third hub seal recess and the first hub seal recess 54. The second and third hub seal recesses 58, 66 may be axially separated from each other by a shoulder portion 70 of the hub 8, thereby creating two separate seal recesses within the hub. It will be appreciated that this is not critical, and in some embodiments the second and third hub seal recesses could be connected or could together be a single recess.

The fourth seal 40 may be positioned within the third hub seal recess 66 so that it seals against a lower central portion 72 of the shaft 28. The lower central portion 72 and the central portion 60 of the shaft 28 may be adjacent to each other, and in one non-limiting exemplary embodiment the lower central portion may have a diameter that is larger than a diameter of the central portion. In the illustrated embodiment, a shoulder portion 74 of the shaft 28 engages the fourth seal 40 when the shaft is coupled to the hub 8 and the handle 2 and presses the fourth seal 40 against the shoulder portion 70 of the hub, thus retaining the fourth seal within the third hub seal recess 66. In one non-limiting exemplary embodiment the fourth seal 40 is a Simmering. The fourth seal 40 may be sized to be press fit into the third hub seal recess 66, and it may also be sized so that a gap "g" is formed between the fourth seal and the shoulder portion 74 of the shaft 28. The gap "g" may ensure that no contact, and thus no friction, occurs between the fourth seal 40 and the shaft 28 during operation of the handle assembly 1.

As arranged, the fourth seal 40 prevents moisture, dust or other foreign materials from passing between the hub 8 and shaft 28. The fourth seal 40 thus act as a tertiary seal against the ingress of material passing the first, second and third seals 34, 36, 38. The fourth seal 40 and the third seal recess 66 may be sized so that the fourth seal 40 remains fixed to the hub 8, and rotates with respect to the shaft 28 when the handle 2 and shaft are rotated. The reverse arrangement is also contemplated, and the fourth seal 40 could be fixed to the shaft 28 and could rotate with respect to the hub 8 as the handle 2 is rotated during operation.

The fifth seal 42 may be received within a circumferential plate seal recess 76 formed in a lower portion 78 of the hub 8. The fifth seal 42 may be presented within the plate seal recess so that it seals against a plate surface 80 of the plate member 16 when the hub 8 is fixed to the plate member. Thus arranged, the fifth seal 42 prevents moisture, dust or other foreign materials from passing between the hub 8 and the plate member 16. In the illustrated embodiment, the fifth seal 42 is an O-ring. As previously noted, in some embodiments the hub 8 and plate member 16 will be formed as a single piece, thus obviating the need for the fifth seal 42.

It will be appreciated that the illustrated embodiment includes specific seal types, that such arrangements are not critical and other types of seals can also be used, a non-limiting listing of which includes Types S, L and E V-rings, O-rings, X-rings, hollow O-rings, square rings, Simmerings, Simmering inflatable (i.e., air pocket) seals, gaskets, formed in place gaskets, and the like.

The first through fifth seals 34-42 can be made from one or more elastomeric materials. In one embodiment, all of the seals are made from the same type of elastomer, while in other embodiments the seals can be made from different elastomeric compositions and/or hardnesses. It will be appreciated that the choice of elastomeric material used for the first through fifth seals 34-42 may be selected to best suit the environment in which the handle assembly 1 will be subjected. A non-limiting exemplary listing of suitable elastomeric materials for the first through fifth seals 34-42 include rubber, nitrile, butadiene, synthetic rubber including ethylene-propylene (EPM, EPR, EPDM), nitrile rubber (NBR), Hydrogenated Nitrile Butadiene Rubber (HBNR), highly saturated nitrile rubber (HSN), neoprene, chloroprene, VMQ or PVMQ silicone rubber, polyester urethane (AU), polyether urethane (EU); fluoropolymer, FVMQ fluorosilicone, fluoromethyl ketone (FMK, FFMK) or a combination thereof. In non-limiting exemplary embodiments the first through fifth seals 34-42 can also have hardnesses of between 40-90 Shore A. In addition, for some embodiments, the elastomeric material used for the first through fifth seals 34-42 can have a desired degree of oil and/or chemical resistance.

In some embodiments, different seal materials can be used for the different seals 34-42 to obtain a universal or almost universal chemical compatible seal. For example, the first seal (V-ring) 34 could be formed from Viton, while the second and third seals (O-ring, X-ring) 36, 38 could be formed from a different material (i.e., one that is resistant to materials for which Viton is unsatisfactory). The fourth seal (Simmering) 40 could also be formed from Viton. Such an arrangement could provide resistance to ingress of a larger number of different chemicals/materials than an arrangement using only a single seal material for all seals in the assembly. The aforementioned combination is merely exemplary, and non-limiting, and a variety of other combinations can be employed depending on the particular installation. The disclosed redundancy of the seal compatibilities may complement and strengthen the resulting chemical barrier to a wide array of chemicals to which the handle assembly 1 will be subject.

As can be seen in FIG. 5, a proximal portion 82 of the shaft 28 (including central portion 60 and lower central portion 72) can be received within a correspondingly sized and shaped shaft recess 84 formed in the hub, while a distal portion 86 of the shaft can be received within a correspondingly sized and shaped shaft recess 88 formed in the handle 2. The shaft 28 may include an axially disposed fastener recess 90 that is sized and configured to receive the central handle fastener 32 therethrough. The handle 2 may include an internally threaded insert 92 sized and configured to threadably engage the external threads of central handle fastener 32. In one embodiment, the internally threaded insert 92 is molded into the handle 2 during manufacturing. The head 94 of the central handle fastener 32 may rest on an inner shoulder portion 96 of the fastener recess 90 such that when the fastener threads engage the threaded insert of the handle 2, the central handle fastener 32 can be rotated to fix the handle 2, hub 8 and shaft 28 together. In one non-limiting exemplary embodiment, an O-ring 98 may be provided between the head 94 of the central handle fastener 32 and the inner shoulder portion 96 of the fastener recess 90. This O-ring may provide yet another seal against the ingress of moisture, dust or other foreign materials between the handle 2, hub 8, and shaft 28. In some embodiments, at least one flat disk spring washer (e.g., a Belleville washer) (not shown) may also be provided between the head of the central handle fastener 32 and the inner shoulder portion 96 of the fastener recess 90. Providing a flat disk spring washer may serve to keep the handle 2, hub 8, and shaft 28 firmly coupled together even if the central handle fastener 32 loosens during operation.

Figure 6A:
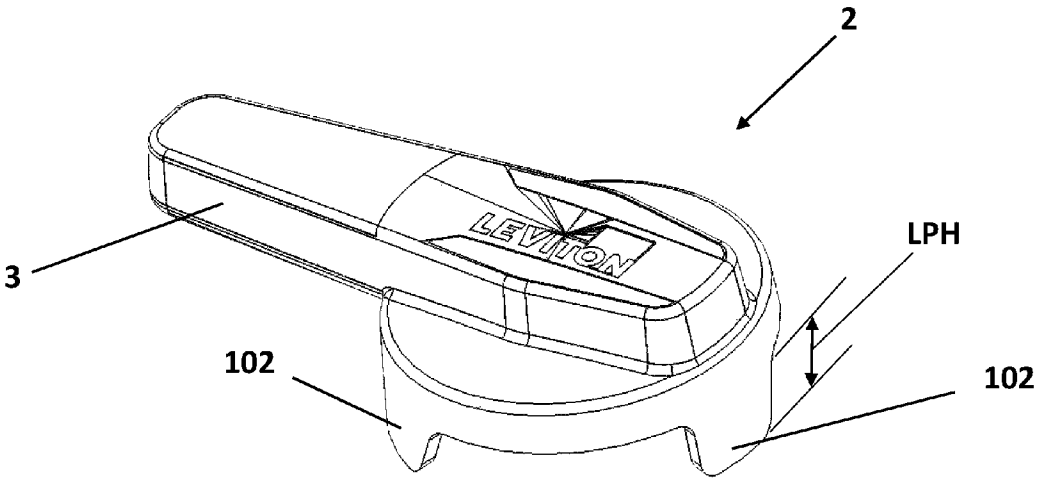
FIGS. 6A and 6B are perspective and reverse perspective views, respectively, of a handle portion of the disclosed locking and sealing arrangement.
Figure 6B:
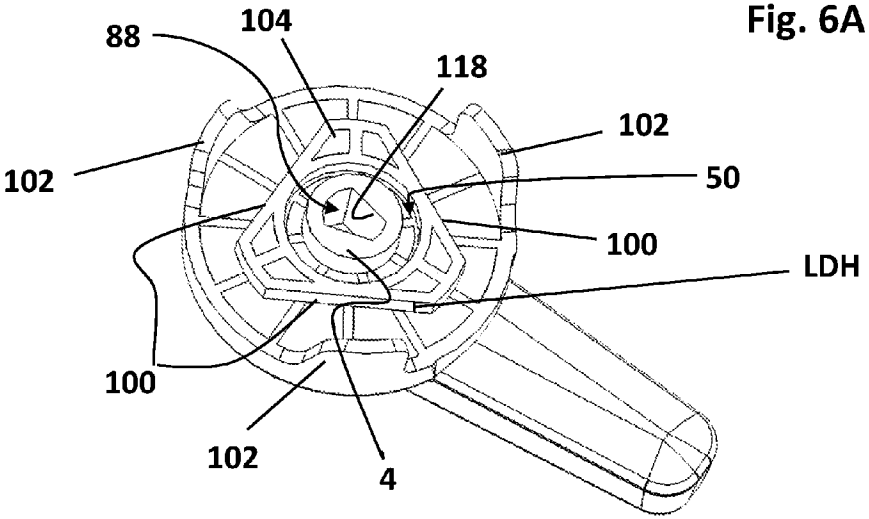

Referring now to FIGS. 6A and 6B, an exemplary embodiment of the handle 2 generally includes a laterally extending grasping portion 3, a hub engaging portion 4, and a handle seal recess 50. The handle 2 may also include the previously described shaft recess 88 for receiving the distal portion 86 of the shaft 28, and the handle seal recess 50 for receiving the first seal 34 therein. The shaft recess 88 may include one or more flat sides 118 for keying to the distal portion 86 of the shaft, as will be described in greater detail later. As previously described, the handle 2 and hub 8 include features for receiving and retaining the shanks of a plurality of locks to enable the handle assembly 1 to be locked against unauthorized operation. The handle thus may include a plurality of lock receiving surfaces including a plurality of handle ledge portions 100 and a plurality of handle lip portions 102. The illustrated embodiment includes three handle ledge portions 100 and three handle lip portions 102, for receiving the shanks of three separate locks. Such an arrangement can be required where the handle assembly 1 is used for operating machinery, where three different individuals each have a key to operate one lock, thus providing a desired high degree of security against unauthorized operation. It will be appreciated that this is not critical, and fewer or greater numbers of handle ledge and lip portions can be used without departing from the disclosure.

As can be seen, the handle ledge portions 100 comprise flat vertical ledges that together form a triangular shaped raised portion 104. The raised portion 104 can be centrally disposed about the axis A-A (see FIG. 3) and surrounds the shaft recess 88 and handle seal recess 50. The handle lip portions 102 may comprise raised lip elements positioned at the circumference of the handle 2. The raised lip elements may have a lip height "LPH" while the handle ledge portions 100 may have a ledge height "LDH" that is smaller than the lip height. The lip height "LPH" may be sized to match the diameter of the shackle 12 of a lock 14 to be used to lock the handle assembly 1, while the ledge height "LDH" may be about one half the diameter of the shackle. In one non-limiting exemplary embodiment, the shackle diameter may be ¼ inch. As can be seen, each of the handle lip portions 102 is positioned directly opposite a respective one of the handle ledge portions 100 to define a region that can receive a shank of a lock therebetween.

In some embodiments, the handle 2 may be molded from two different materials, including a structural polymer skeleton layer and softer over-layer that provides an enhanced tactile feel. Such dual-shot molding provides a solid continuous surface around the entire handle 1, including areas not protected by seals. The resulting surface can be smooth, free of crevices, and easy to clean.

The disclosed handle 2 may have a smooth outer surface free of pockets or ribs/no pockets/ribs. Cosmetic appeal can also be enhanced as a dual color may be imparted to the handle 2, allowing an appropriate color choice to satisfy high visibility requirements desired to satisfy applicable standards. For example, the coloration of the handle 2 may comply with national safety color standards of ANSI Z535.

Figure 7C:
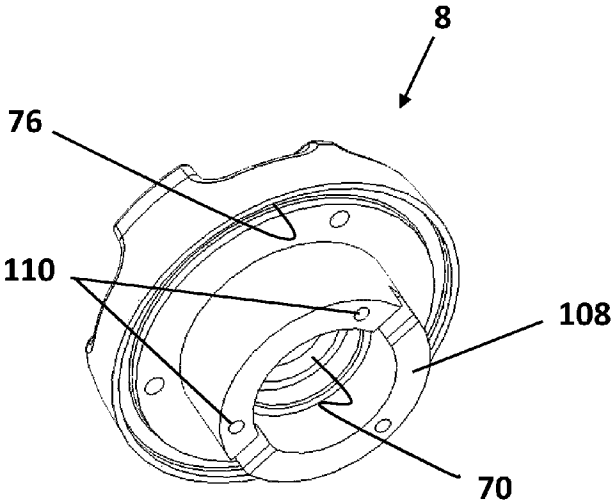
FIGS. 7A-7C are a perspective view, a side view, and a reverse perspective view, respectively, of a hub portion of the disclosed locking and sealing arrangement.
Figure 7A:
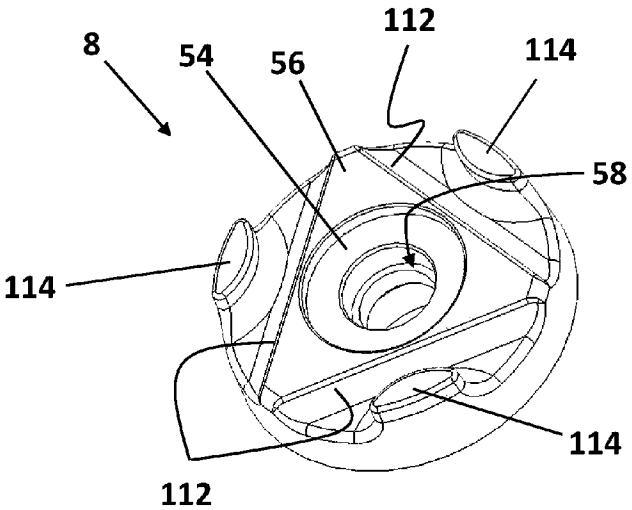
Figure 7B:
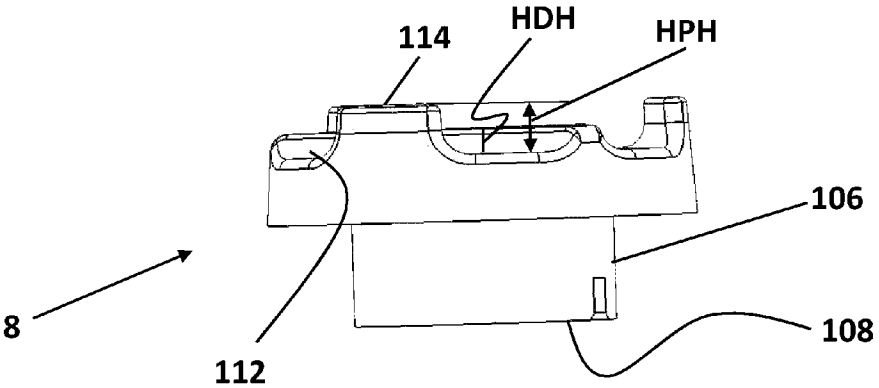

FIGS. 7A-7C show an exemplary embodiment of the hub 8, including a handle engaging portion 56, first hub seal recess 54, second hub seal recess 58, third hub seal recess 66, and plate seal recess 76. Shoulder portion 70 can separate the second and third hub seal recesses 58, 66. The hub 8 can further include a plate engaging portion 106 that extends away from the handle engaging portion 56 and which is sized and configured to be received through opening 18 in the plate member 16 (see FIG. 2.) An end face 108 of the plate engaging portion 106 is sized and configured to receive the stop plate (see FIG. 2), which can be fixed to the hub via a plurality of fasteners 26 received in threaded recesses 110.

Like the handle, the hub 8 may include a plurality of lock receiving surfaces including a plurality of hub ledge portions 112 and a plurality of hub lip portions 114. The illustrated embodiment includes three hub ledge portions 112 and three hub lip portions 114 corresponding to the three handle ledge and lip portions 100, 102 of the handle. It will be appreciated that this is not critical, and fewer or greater numbers of hub ledge and lip portions can be used without departing from the disclosure.

As can be seen, the hub ledge portions 112 comprise flat ledges that together form the handle engaging portion 56. The handle engaging portion 56 is centrally disposed about the axis A-A (see FIG. 3). The hub lip portions 114 comprise raised lip elements positioned at equally spaced locations about the circumference of the hub 8. The raised lip elements may have a lip height "HPH" while the hub ledge portions 112 may have a ledge height "HDH" that is smaller than the lip height. As with the handle lip portions and handle ledge portions, the lip height "HPH" of the hub lip portions 114 may be sized to be about the same as the diameter the shackle 12 of a lock 14 used to lock the handle assembly 1. The ledge height "HDH" of the hub ledge portions 112 may be about half the diameter of the shackle to ensure minimum angular play of the handle 2 when the handle assembly 1 is in the locked position. As can be seen, each of the hub lip portions 114 is positioned directly opposite a respective one of the hub ledge portions 112 to define a region that can receive a shank of a lock therebetween.

As can also be seen, the hub 8 employs smooth surfaces and a relatively shallow profile, which minimizes or eliminates crevice formation and facilitates cleaning. As mentioned, this can be advantageous for applications that require adherence to sanitary standards.

The geometry and features of the hub 4 and handle 2 make them manufacturable from a wide variety of materials, a non-limiting list including metal (e.g., stainless steel, copper, brass, aluminum), polymer (e.g., thermoplastics, thermosets), and ceramics. Further, the hub 4 and handle 2 can be manufactured using any of a variety of processes, a non-limiting list including machining, molding and casting. Using the aforementioned processes and materials enable the hub 4 and handle 2 to be manufactured to the surface finish/roughness requirements of applicable sanitary standards. Further, in some embodiments, one or more surfaces of the hub 4 and handle 2 can be provided with an antimicrobial coating, which may be applied as a resin coating, an electrocoating, a powder coating or the like.

Figure 8B:
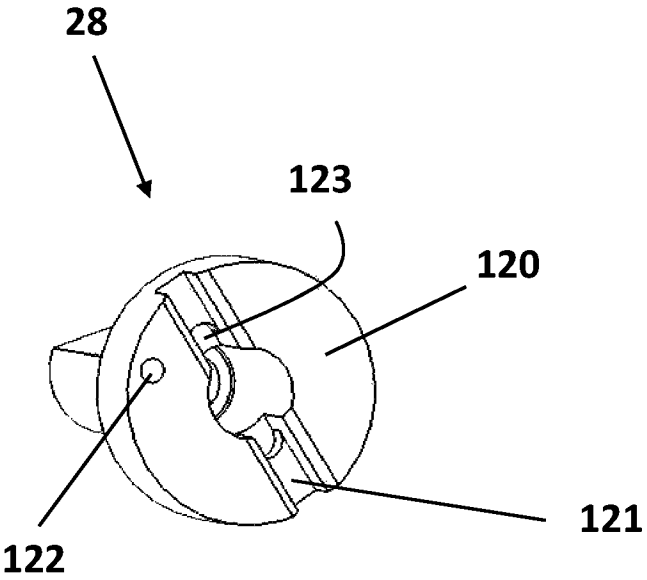
FIGS. 8A and 8B are a perspective view and a reverse perspective view, respectively, of a shaft portion of the disclosed locking and sealing arrangement.
Figure 8A:
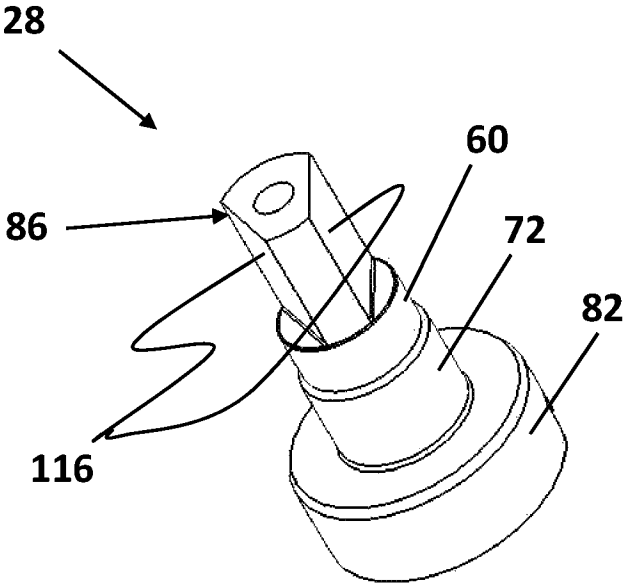

FIGS. 8A and 8B show an exemplary embodiment of the shaft 28, including proximal portion 82, that is received within the shaft recess 88 (FIG. 6) formed in the handle 2, distal portion 86, that is rotatably received within a correspondingly sized and shaped shaft recess 84 formed in the hub (FIG. 5). Central portion 60 and lower central portion 72 can be positioned between the proximal and distal portions 82, 86. Fastener recess 90 is disposed throughout the axial length of the shaft 28 and is sized receive the central handle fastener 32 therethrough.

The end face 120 of the shaft may include a lateral slot 121 that passes through an end portion of the central fastener recess 90. Within the lateral slot 121 may dispose a key slot 123. The key slot 123 may be sized and configured to receive a portion of a load switch, as will be described further in relation to FIG. 9.

As previously noted, during operation the shaft 28 rotates with the handle 2. Thus, the distal portion 86 of the shaft 28 includes a pair of flat sides 116 that correspond to similar flat sides 118 (FIG. 6B) of the handle recess 88. The corresponding flats key the shaft 28 to the handle 2 so that the two rotate together. The proximal end 82 of the shaft 28 includes an end face 120 having an opening 122 sized and shaped to receive the motion limiting pin 20 (see FIG. 2). Thus arranged, rotation of the handle 2 rotates the shaft 28 and the motion limiting pin 20.

Figure 9:
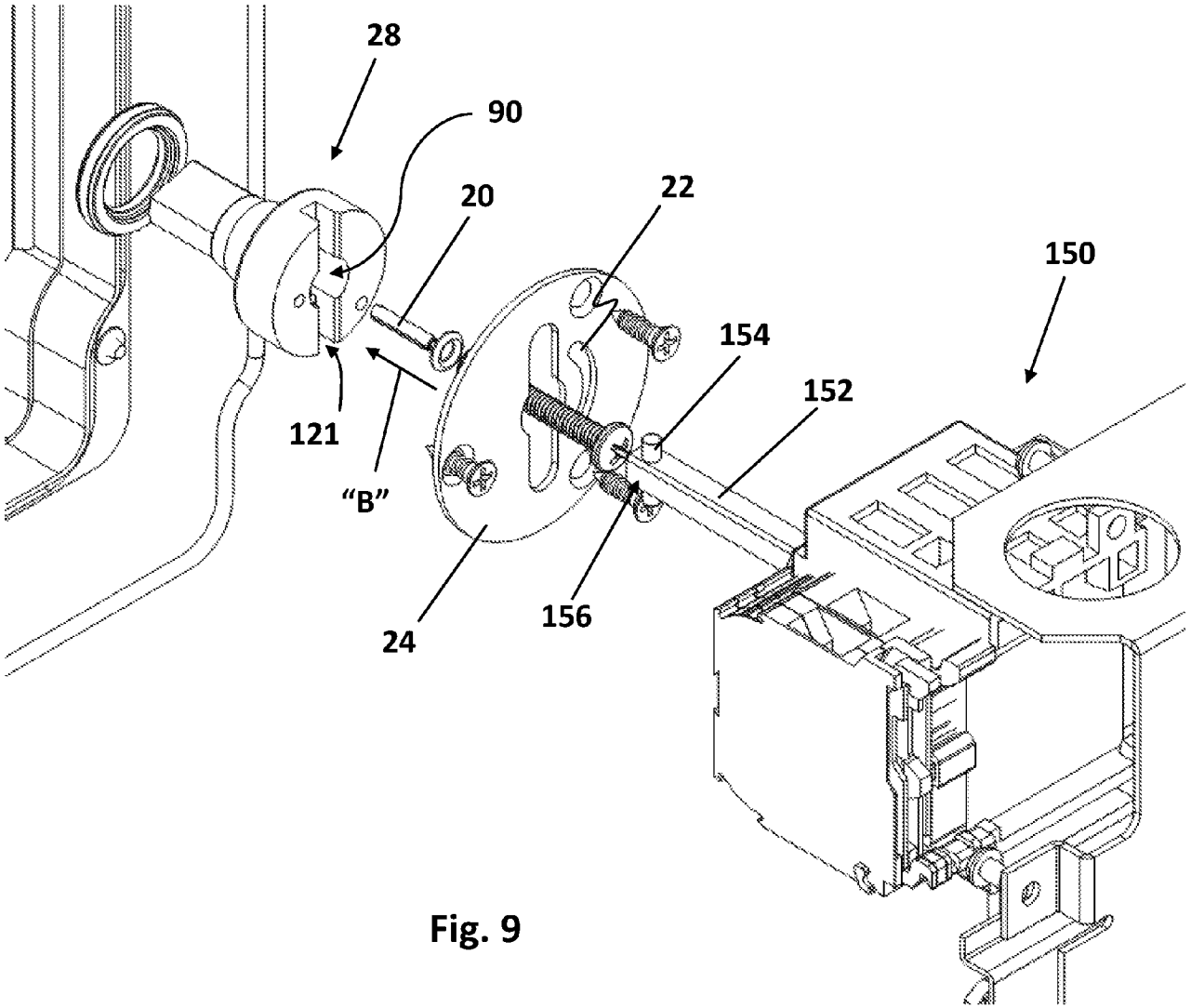
FIG. 9 is an exploded perspective view of the interaction between the shaft portion of the disclosed locking and sealing arrangement and the switch element of an exemplary load switch.

As shown in FIG. 9, an associated load switch 150 may be equipped with a switch shaft 152 having a lateral pin 154 disposed at a distal end 156 thereof. The distal end 156 of the switch shaft 152 may be received within the central fastener recess 90 of the shaft 28 (when the pinned shaft 152 is moved in the direction of arrows "B") such that the lateral pin 154 is guided into the key slot 123 (FIG. 8B) of the shaft, which may rotationally lock the shaft 28 to the switch shaft 152. Thus arranged, rotational movement of the handle 2 causes the shaft 28 to rotate, which in turn rotates the pinned shaft 152 via the pin/slot interaction. A load associated with the load switch 150 can thus be energized or de-energize, depending on the direction of rotation of the pinned shaft.

Figure 10:
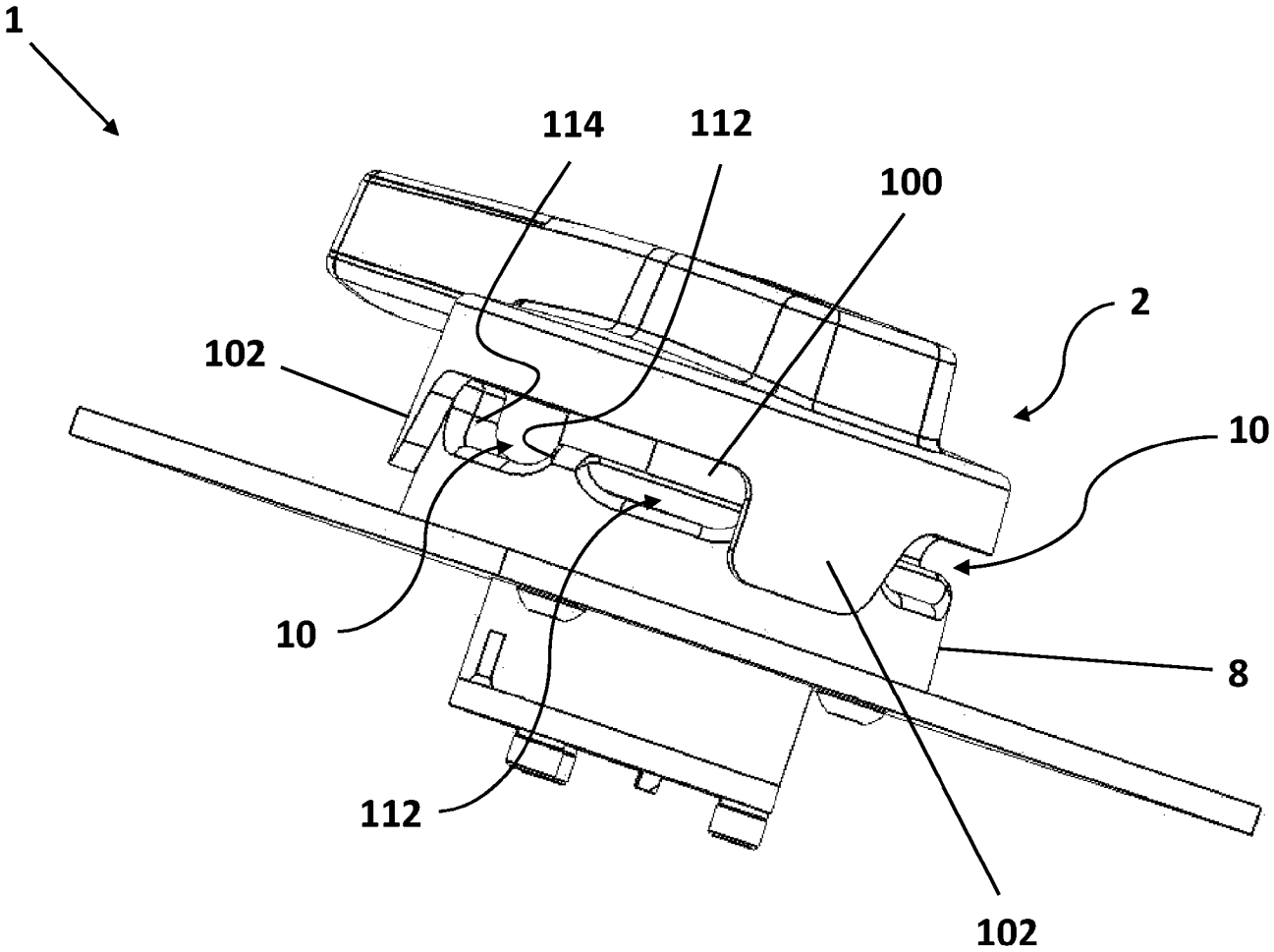
FIG. 10 is a side view of the disclosed locking and sealing arrangement illustrating exemplary shank openings formed between the handle and hub portions.

Referring now to FIG. 10, the handle assembly 1 is shown with the handle 2 and hub 8 assembled and rotated into relative position so that a plurality of shank openings 10 are formed between the handle and hub. As previously mentioned, in this position the shank openings 10 are configured to receive the shank portions 12 of a plurality of locks 14 therein. As can be seen, to form the shank openings 10 the handle lip portions 102 and hub lip portions 114 are aligned with each other, and the handle ledge portions 100 and the hub ledge portions 112 are aligned with each other.

Figure 11:
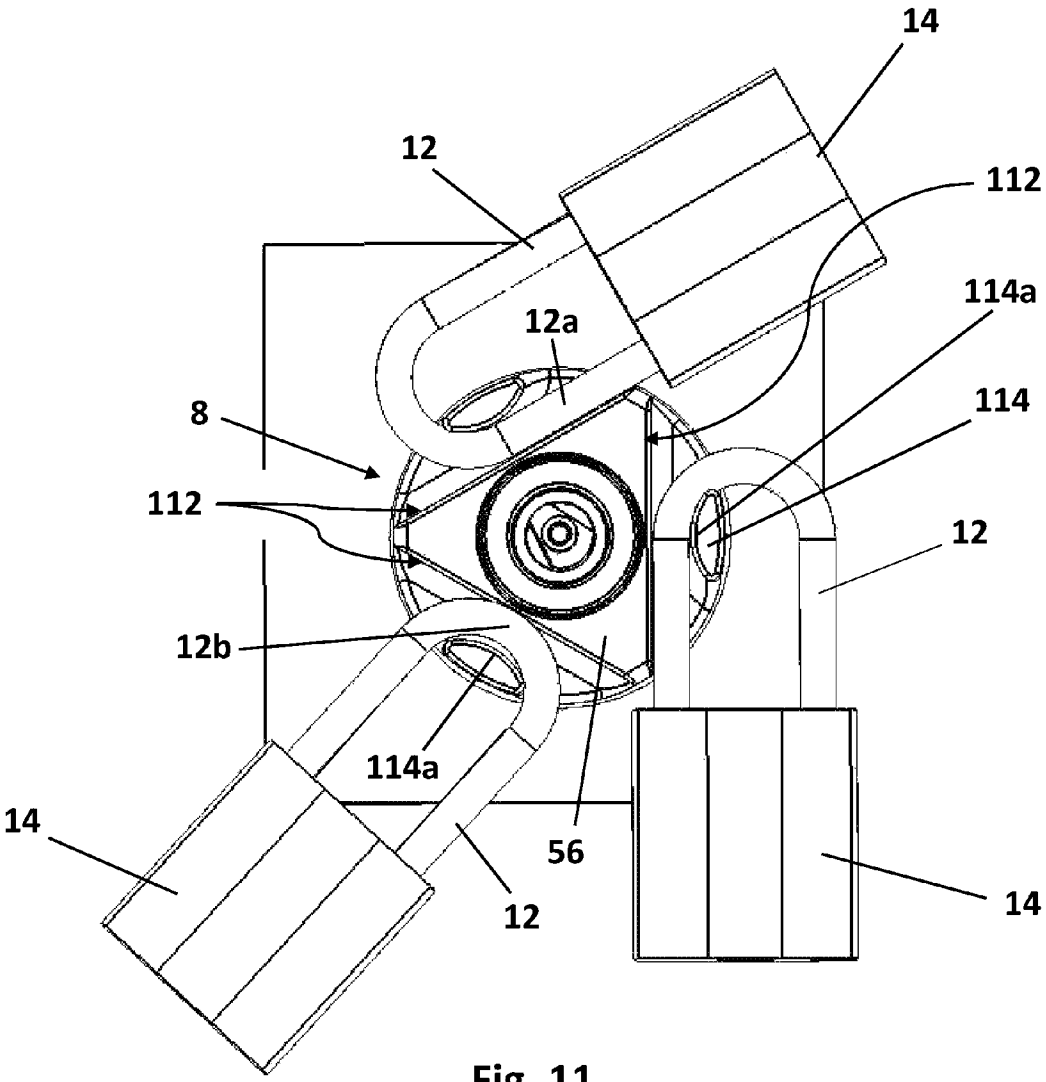
FIG. 11 is a top view of a portion of the disclosed locking and sealing arrangement showing an exemplary interaction between the hub portion and a plurality of padlocks.

As can be seen, the opposing surfaces of the hub and handle lip and ledge portions are configured in a manner such that water, dust or other contaminants will not accumulate within the handle assembly 1. Thus, the surfaces of the handle 2 and hub 8 can be angled and/or a large space is provided between surfaces to prevent such accumulation FIG. 11 is a top view of a portion of the disclosed handle assembly 1 showing an exemplary interaction between the hub 8 and the shanks 12 of a plurality of locks 14. As can be seen, the shanks 12 of each of the padlocks are held between opposing pairs of hub lip portions 114 and hub ledge portions 112. As can also be seen, the shanks 12 and locks 14 can be held at a variety of positions with respect to the hub 8. Thus, two of the shanks 12 are held between the lip/ledge 114/112 along the linear portion 12*a*, while one of the shanks is held between the lip/ledge along the curved portion 12*b*. In the illustrated embodiment, the hub lip portions 114 have a curved surface 114*a* that corresponds generally to the interior curvature of the curved portion 12*b* of the shanks.

Figure 12:
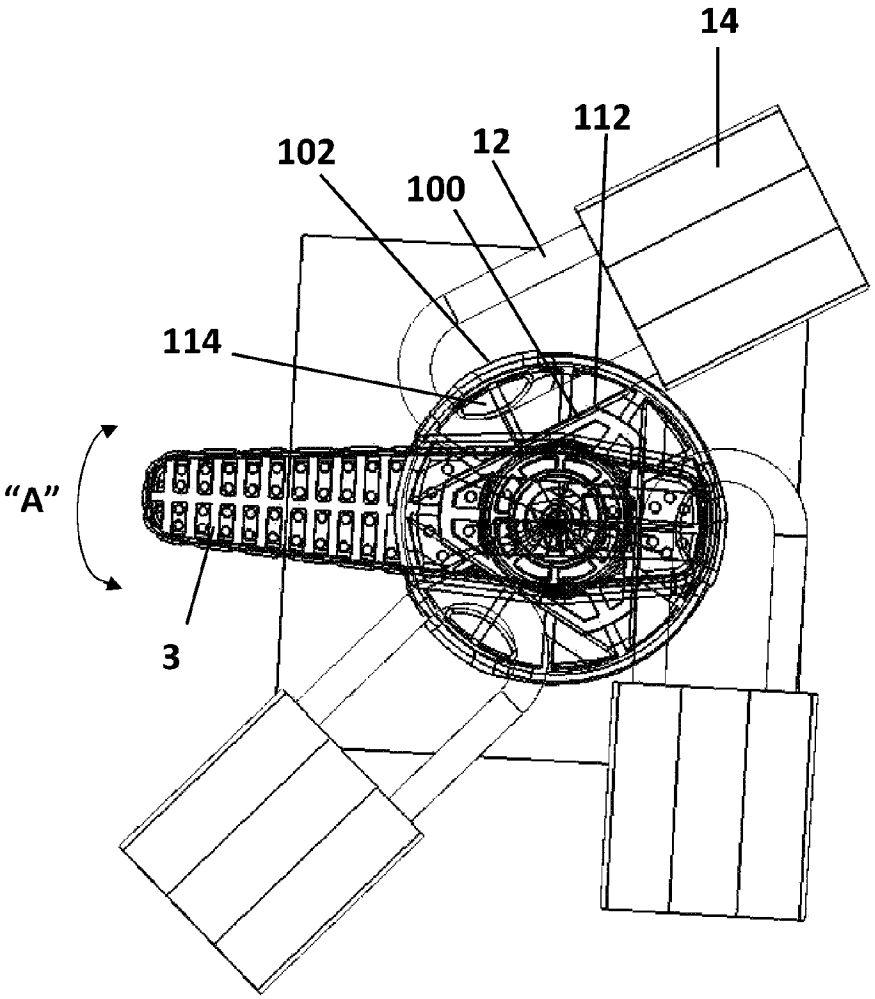
FIG. 12 is a partially transparent top view of a portion of the disclosed locking and sealing arrangement showing an exemplary interaction between the hub portion, the handle portion, and a plurality of padlocks.

FIG. 12 is a partially transparent top view of a portion of the disclosed handle assembly 1 showing the shanks 12 of the locks 14 held between the handle lip portions 102, the hub lip portions 114, the handle ledge portions 100 and the hub ledge portions 122. As will be appreciated, with even one shank 12 positioned between the lips and ledges, the handle 2 will be prevented from being actuated (i.e., rotated in the direction of arrow "A") due to binding between the shanks and the lips/ledges. As will be appreciated, having three locks 14 in a triangular array allows the installation of each lock in a variety of positions and independent on each other. The shape of handle allows the padlock to rotate around the handle lip portions 102, while still binding the handle lip portions on the associated shank 12.

Figure 14:
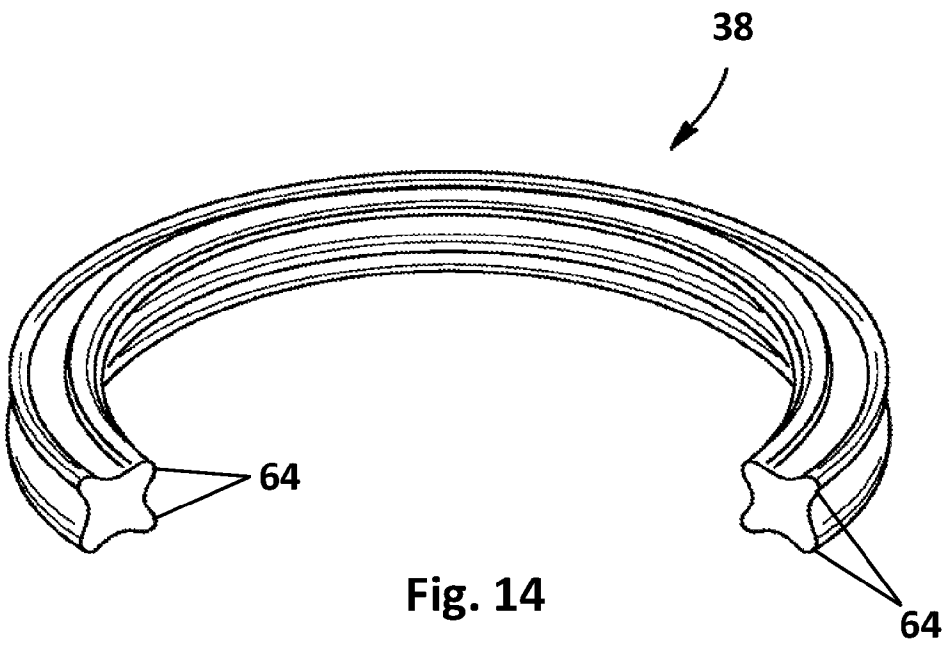
FIGS. 13 and 14 are perspective views of exemplary sealing elements of the disclosed locking and sealing arrangement.
Figure 13:
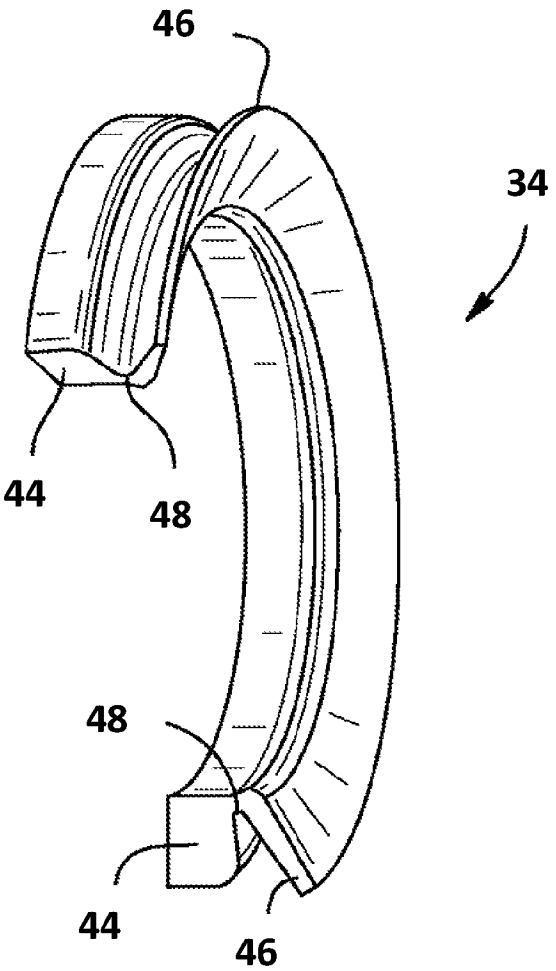

FIG. 13 shows a cutaway view of an exemplary V-ring for use as the first seal 34. The illustrated V-ring 34 includes a body portion 44, a lip portion 46 and a living hinge portion 48 disposed between the body portion and lip portion. FIG. 14 shows exemplary X-ring for use as the third seal 38. The X-ring 38 includes four lobes 64 disposed at four corners of the X-ring.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. A handle assembly, comprising:

a handle having a grasping portion, a handle seal recess, and a hub engaging portion;

a hub having a lock receiving surface and a handle engaging portion;

a shaft receivable within the hub, the shaft having first and second ends, the first end engaged with the handle, the second end comprising an actuating surface that is rotatable by rotating the grasping portion of the handle; and a first seal comprising a V-ring disposed within the handle seal recess, the V-ring engaging a sealing face of the hub to prevent moisture ingress between the handle and the hub.

2. The handle assembly of claim 1, wherein the V-ring is receivable within a first hub seal recess, the first hub seal recess including the sealing face.

3. The handle assembly of claim 1, the hub having a second hub seal recess disposed about a central portion of the shaft, and a second seal disposed within the second huh seal recess such that the second seal engages the second hub seal recess and the central portion of the shaft to prevent moisture ingress between the hub and the shaft.

4. The handle assembly of claim 3, wherein the second seal is an O-ring or an X-ring.

5. The handle assembly of claim 3, further comprising a third seal disposed within the second huh seal recess, the third seal positioned between the second seal and the hub engaging portion of the handle.

6. The handle assembly of claim 5, wherein the second seal is an X-ring and the third seal is an O-ring, and wherein axial pressure applied to the O-ring by the hub engaging portion of the handle causes the O-ring to press against the X-ring to force at least one lobe of the X-ring against the central portion of the shaft.

7. The handle assembly of claim 5, further comprising a fourth seal disposed within a third hub seal recess, the fourth seal positioned between the hub and the central portion of the shaft to prevent moisture ingress between the hub and the shaft.

8. The handle assembly of claim 7, wherein the fourth seal is held within the third hub seal recess by a first shoulder of the shaft.

9. The handle assembly of claim 8, wherein the fourth seal is a simmering.

10. The handle assembly of claim 1, the handle and hub further comprising respective lock receiving surfaces for receiving a shank portion of a lock therebetween.

11. The handle assembly of claim 10, wherein the lock receiving surface of the handle comprises a handle ledge portion disposed opposite a handle lip portion, and the lock receiving surface of the hub comprises a hub ledge portion disposed opposite a hub lip portion.

12. The handle assembly of claim 11, wherein the handle is rotatable with respect to the hub such that in a first rotational position the handle and hub ledge portions and the handle and hub lip portions align to form a shank opening sized and configured to enable the shank portion of the lock to be received therebetween.

13. The handle assembly of claim 12, wherein when the shank portion of the lock is received within the shank opening further rotation of the handle with respect to the hub is prevented by the shank portion engaging the handle and hub ledge portions and the handle and hub lip portions.

14. The handle assembly of claim 13, wherein the handle and hub ledge portions comprise a plurality of handle and hub ledge portions and the handle and hub lip portions comprise a plurality of handle and hub lip portions, the plurality of handle and hub ledge portions and the plurality of handle and hub lip portions positioned with respect to each other to form a plurality of shank openings when the handle assembly is configured in the first rotational position, wherein each of the plurality of shank openings is sired and configured to receive a respective shank of a plurality of locks.

15. A handle assembly, comprising:

a handle having a grasping portion, a handle seal recess, and a hub engaging portion;

a hub having a lock receiving surface, a handle engaging portion and first and second hub seal recesses;

a shaft receivable within the hub, the shaft having first and second ends, the first end engaged with the handle, the second end comprising an actuating surface that is rotatable by rotating the grasping portion of the handle;

a first seal comprising a V-ring disposed within the handle seal recess and the first hub seal recess, the V-ring engaging a sealing face of the hub to prevent moisture ingress between the handle and the hub; and a second seal disposed in the second huh seal recess, the second hub seal recess disposed about a central portion of the shaft, the second seal comprising an X-ring, wherein opposing sealing surfaces of the X-ring seal engage the second hub seal recess and the central portion of the shaft to prevent moisture ingress between the hub and the shaft.

16. The handle assembly of claim 15, further comprising an O-ring seal disposed within the second hub seal recess, the O-ring seal positioned between the X-ring seal and the huh engaging portion of the handle, wherein force applied to the O-ring by the hub engaging portion of the handle causes the O-ring to press against the X-ring to force at least one lobe of the X-ring against the central portion of the shaft.

17. The handle assembly of claim 16, further comprising a simmering disposed within a third hub seal recess, the simmering positioned between the hub and the central portion of the shaft to prevent moisture ingress between the huh and the shaft, the simmering held within the third hub seal recess by a first shoulder of the shaft.

18. The handle assembly of claim 15, the handle and hub further comprising respective lock receiving surfaces for receiving a shank portion of a lock therebetween, wherein the lock receiving surface of the handle comprises a handle ledge portion disposed opposite a handle lip portion, and the lock receiving surface of the huh comprises a hub ledge portion disposed opposite a huh lip portion.

19. The handle assembly of claim 18, wherein the handle is rotatable with respect to the hub such that in a first rotational position the handle and hub ledge portions and the handle and hub lip portions align to form a shank opening sized and configured to enable the shank portion of the lock to be received therebetween, and wherein when the shank portion of the lock is received within the shank opening further rotation of the handle with respect to the huh is prevented by the shank portion engaging the handle and hub ledge portions and the handle and hub lip portions.

20. The handle assembly of claim 19, wherein the handle and hub ledge portions comprise a plurality of handle and huh ledge portions and the handle and hub lip portions comprise a plurality of handle and hub lip portions, the plurality of handle and hub ledge portions and the plurality of handle and hub lip portions positioned with respect to each other to form a plurality of shank openings when the handle assembly is configured in the first rotational position, wherein each of the plurality of shank openings is sized and configured to receive a respective shank of a plurality of locks.

21. A handle assembly, comprising:

a handle having a grasping portion, a handle seal recess, and a huh engaging portion;

a hub having a lock receiving surface, a handle engaging portion and first and second huh seal recesses;

a shaft receivable within the hub, the shaft having first and second ends, the first end engaged with the handle, the second end comprising an actuating surface that is rotatable by rotating the grasping portion of the handle; and a first seal comprising a V-ring disposed within the handle seal recess and the first hub seal recess, the V-ring engaging a sealing face of the hub to prevent moisture ingress between the handle and the huh;

wherein the handle and hub further comprising respective lock receiving surfaces for receiving a shank portion of a lock therebetween, wherein the lock receiving surface of the handle comprises a handle ledge portion disposed opposite a handle lip portion, and the lock receiving surface of the hub comprises a hub ledge portion disposed opposite a hub lip portion.

22. The handle assembly of claim 21, wherein the handle is rotatable with respect to the hub such that in a first rotational position the handle and huh ledge portions and the handle and hub lip portions align to form a shank opening sized and configured to enable the shank portion of the lock to be received therebetween.

23. The handle assembly of claim 21, wherein the handle and hub ledge portions comprise a plurality of handle and hub ledge portions and the handle and hub lip portions comprise a plurality of handle and hub lip portions, the plurality of handle and hub ledge portions and the plurality of handle and hub lip portions positioned with respect to each other to form a plurality of shank openings when the handle assembly is configured in the first rotational position, wherein each of the plurality of shank openings is sized and configured to receive a respective shank of a plurality of locks.

* * * * *